US008579396B2

(12) United States Patent
Frazier et al.

(10) Patent No.: US 8,579,396 B2
(45) Date of Patent: Nov. 12, 2013

(54) FLUID LEVEL SENSING SYSTEM AND METHOD

(71) Applicant: Xerox Corporation, Norwalk, CT (US)

(72) Inventors: Isaac S. Frazier, Portland, OR (US); David L. Knierim, Wilsonville, OR (US); James M. Bonicatto, Seattle, WA (US); Michael Norkitis, Seoul (KR)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/664,538

(22) Filed: Oct. 31, 2012

(65) Prior Publication Data

US 2013/0050313 A1 Feb. 28, 2013

Related U.S. Application Data

(62) Division of application No. 12/164,714, filed on Jun. 30, 2008, now Pat. No. 8,382,221.

(51) Int. Cl.
*B41J 29/393* (2006.01)
*B41J 2/195* (2006.01)

(52) U.S. Cl.
USPC ..... 347/7; 347/19

(58) Field of Classification Search
USPC ..... 347/7, 19
See application file for complete search history.

(56) References Cited

U.S. PATENT DOCUMENTS

| | | | |
|---|---|---|---|
| 5,546,005 | A | 8/1996 | Rauchwerger |
| 5,988,783 | A | 11/1999 | Tajika et al. |
| 6,318,826 | B1 | 11/2001 | Froger et al. |
| 7,134,331 | B2 | 11/2006 | Eguchi et al. |
| 2001/0035887 | A1 | 11/2001 | Altfather et al. |
| 2003/0160835 | A1 | 8/2003 | Barry et al. |
| 2006/0250446 | A1 | 11/2006 | Wanibe et al. |
| 2007/0076023 | A1 | 4/2007 | Knierim et al. |

*Primary Examiner* — Jannelle M Lebron
(74) *Attorney, Agent, or Firm* — Maginot, Moore & Beck, LLP

(57) ABSTRACT

An ink level sensing system that exhibits good sensitivity is described herein. The system includes a first probe having a first active surface, a second probe having a second active surface facing the first active surface, a memory in which data indicative of a conductivity curve and command instructions are stored, and a processor configured to execute the command instructions to associate a level of fluid in a reservoir with a first signal indicative of the electrical coupling between the first active surface and the second active surface with reference to the data indicative of a conductivity curve.

4 Claims, 15 Drawing Sheets

FLUID LEVEL SENSING SYSTEM AND METHOD

PRIORITY CLAIM

This document claims priority to U.S. patent application Ser. No. 12/164,714, which was filed on Jun. 30, 2009 and is entitled "Fluid Level Sensing System And Method." The application issued as U.S. Pat. No. 8,382,221 on Feb. 26, 2013.

BACKGROUND

This invention relates to fluid level sensing and more particularly to ink tank level sensing.

Ink level detection in a printhead is required in printing systems where the main volume of liquid ink is stored in a reservoir away from the printhead. In order to perform full color printing, four kinds of inks, i.e., cyan ink, magenta ink, yellow ink and black ink, must be used. Accordingly, color printers may include four different fluid reservoirs, one reservoir for each type of ink. As the printhead consumes ink, the reservoirs periodically need to be refilled. Sensors are used to detect whether or not the printhead has adequate ink.

There are numerous methods by which liquid ink detection has previously been performed. Most of these methods rely on the electrical conductivity of the ink and use the ink to complete a "sensing" circuit. In these systems the reservoir containing the ink is frequently made of a conductive material and forms part of the circuit. A probe made of conductive material, either a metal protrusion insulated from the reservoir or a conductive pad on an insulated circuit board, is used as the sensor and the ink bridges the space between the probe and the reservoir to complete the circuit.

These sensing systems suffer from various shortcomings. For example, the systems typically have limited sensitivity leading to inaccuracies and some systems are unable to detect various inks, particularly those with low levels of conductivity.

Thus, printers having sensing systems with good sensitivity or that sense an ink level without relying on the conductive properties of the reservoir containing the fluid would be beneficial.

SUMMARY

An ink level sensing system that exhibits good sensitivity is described herein. The system includes a first probe having a first active surface, a second probe having a second active surface facing the first active surface, a memory in which data indicative of a conductivity curve and command instructions are stored, and a processor configured to execute the command instructions to associate a level of fluid in a reservoir with a first signal indicative of the electrical coupling between the first active surface and the second active surface with reference to the data indicative of a conductivity curve.

In accordance with another embodiment, a method of sensing the level of at least one fluid in a device includes applying a voltage to a first probe in a first reservoir to generate a first calibration current, receiving the first calibration current with a first surface of a second probe, obtaining a plurality of first data indicative of the received first calibration current, associating each of the plurality of first data with a different one of a plurality of surface areas of the first surface contacting a first fluid in the first reservoir, storing the associated plurality of first data in a memory, applying the voltage to the first probe to generate a first operational current, receiving the first operational current with the first surface of the second probe, obtaining a first signal indicative of the received first operational current, and associating the first signal with one of the plurality of first data.

Pursuant to yet another embodiment, a printer device includes at least one reservoir for storing ink used by the device, a first driver probe positioned within the at least one reservoir, a sense probe positioned within the at least one reservoir and spaced apart from the first driver probe, a boot supporting the first driver probe and the sense probe, the boot configured to electrically isolate the first driver probe and the sense probe from each other and from the at least one reservoir, a memory in which data indicative of a conductivity curve associated with ink stored in the at least one reservoir and command instructions are stored, and a processor configured to execute the command instructions to associate a level of the ink in the at least one reservoir with a signal indicative of the electrical coupling between the first driver probe and the sense probe using the data indicative of a conductivity curve.

DESCRIPTION

Figure 1:
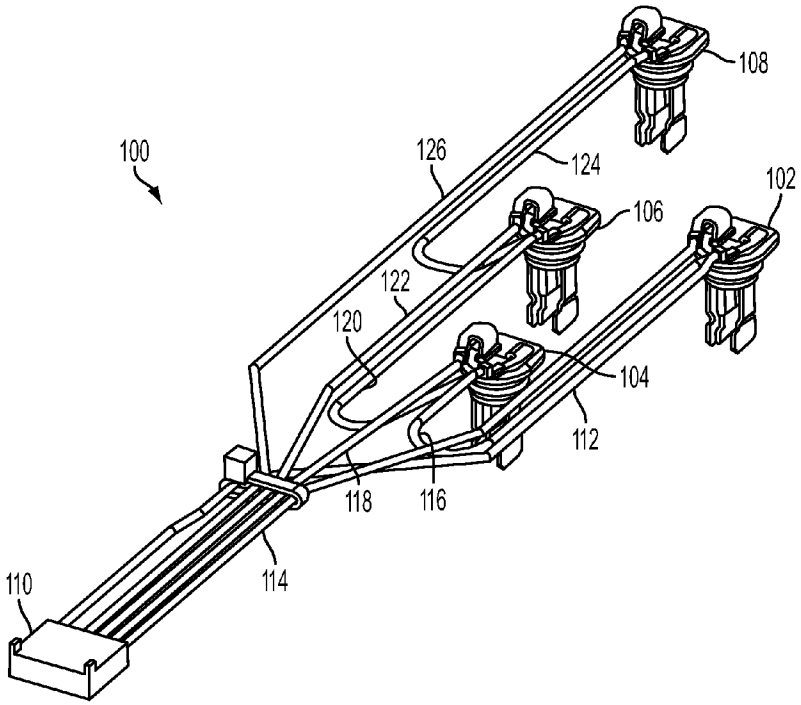
FIG. 1 depicts a perspective view of a sensor system with four probe assemblies incorporating principles of the invention.

With initial reference to FIG. 1, a sensor assembly 100 includes four probe assemblies 102, 104, 106, and 108, and a connector 110. A supply lead 112 and a return lead 114 extend between the connector 110 and the probe assembly 102. A branch supply lead 116 branches from the supply lead 112 and extends to the probe assembly 104 while a return lead 118 extends between the connector 110 and the probe assembly 104. Similarly, a branch supply lead 120 branches from the branch supply lead 116 and extends to the probe assembly 106 while a return lead 122 extends between the connector 110 and the probe assembly 106. Additionally, a branch supply lead 124 branches from the branch supply lead 120 and extends to the probe assembly 108 while a return lead 126 extends between the connector 110 and the probe assembly 108

The probe assemblies 102, 104, 106, and 108 are identically formed in this embodiment and are further described with reference to the probe assembly 102 depicted in FIGS. 2-5. The probe assembly 102 includes a central sense probe 130 and two outer driver probes 132 and 134. A prong 136 is used to couple the sense probe 130 with the return lead 114 and a prong 138 is used to couple the driver probes 132 and 134 with the supply lead 112.

The sense probe 130 includes a shank portion 140 and a plate portion 142. The sense probe 130 and the prong 136 are integrally formed as a sense member 144. In this embodiment, the sense member 144 is formed from a single sheet of conductive material, such as stainless steel, which can be easily stamped and formed into the desired shape.

Similarly, the driver probes 132 and 134 and the prong 138 are integrally formed as a drive member 150 which can be formed from a single sheet of conductive material such as stainless steel which can be easily stamped and formed into the desired shape. The drive member 150 includes a crossbar 152 which joins the driver probes 132 and 134. The driver probes 132 and 134 include shank portions 154 and 156 and plate portions 158 and 160, respectively. A curved section 162 joins the shank portion 154 and the plate portion 158 while a curved section 164 joins the shank portion 156 and the plate portion 160.

The sense member 144 and the drive member 150 are supported by a boot 170. The boot 170 includes a platform 172, a seal portion 174 and a barb portion 176. A sleeve 178 extends downwardly from the lower surface of the barb portion 176. The boot 170 in this embodiment is made of silicone rubber, but other elastomeric materials could also be used.

The probe assembly 102 may be manufactured by inserting the sense member 144 and the drive member 150 into a compression mold, and then over-molding the silicone rubber material of the boot 170 around them. Alternatively, multiple materials may be overlaid in multiple steps or by other processes. Additionally, while the sense probe 130 the driver probes 132 and 134 may be constructed from the same metal and in the particular shapes shown herein, a probe, which is an electrically conductive member, may be made from any conductive material in sheet or other form. Additionally, the shapes of the probes may be modified for different applications.

Figure 6:
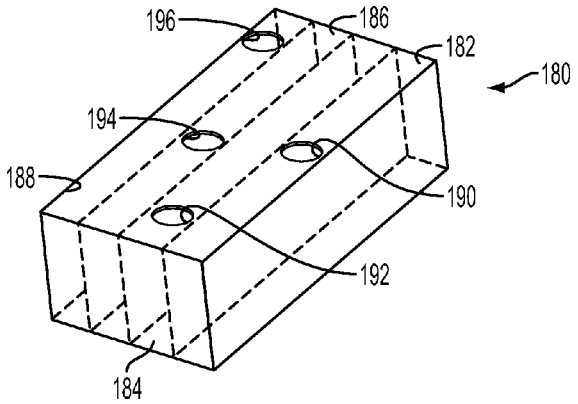
FIG. 6 depicts a tank with four reservoirs, each reservoir including a port for receiving a probe assembly.
Figure 7:
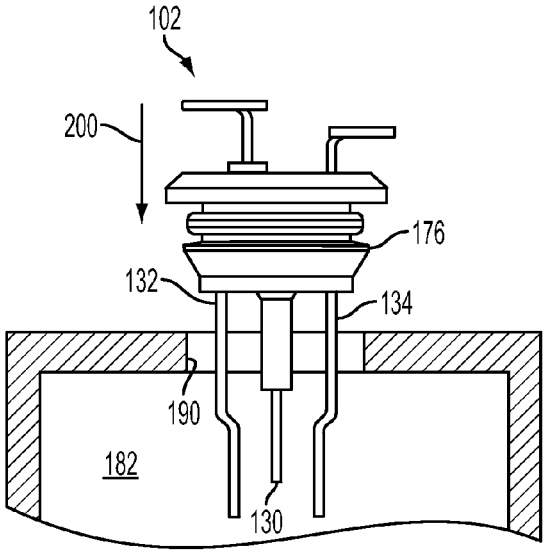
FIG. 7 depicts a partial cross-sectional view of the tank of FIG. 6 with the probe assembly of FIG. 2 partially inserted through the port.

The sensor assembly 100 may be used with the tank 180 of FIG. 6. The tank 180, which in one embodiment is made from cast aluminum, may be used in a printer or other device for storing four different fluids used by the device. The tank 180 includes reservoirs 182, 184, 186, and 188. More or fewer reservoirs may be provided either separately or within a single tank and the fluid within multiple reservoirs may be the same if so desired. Each of the reservoirs 182, 184, 186, and 188 includes a port 190, 192, 194, and 196, respectively.

Other ports (not shown) may be provided for each of the reservoirs 182, 184, 186, and 188 for other purposes such as for filling and draining. The ports 190, 192, 194, and 196, however, are configured to allow for sensing of a fluid level within the respective reservoir. Accordingly, each of the ports 190, 192, 194, and 196 is sized to receive a probe assembly such as probe assembly 102. Referring to FIGS. 7-10, insertion of a probe assembly 102 into the reservoir 182 is performed by inserting the sense probe 130 and the driver probes 132 and 134 into the port 190 in the direction of the arrow 200.

Figure 8:
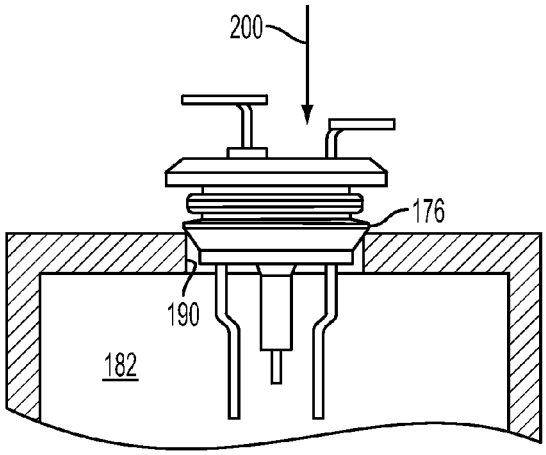
FIG. 8 depicts a partial cross-sectional view of the tank of FIG. 6 with the barbed portion of the probe assembly of FIG. 2 contacting the surface of the tank about the port.
Figure 9:
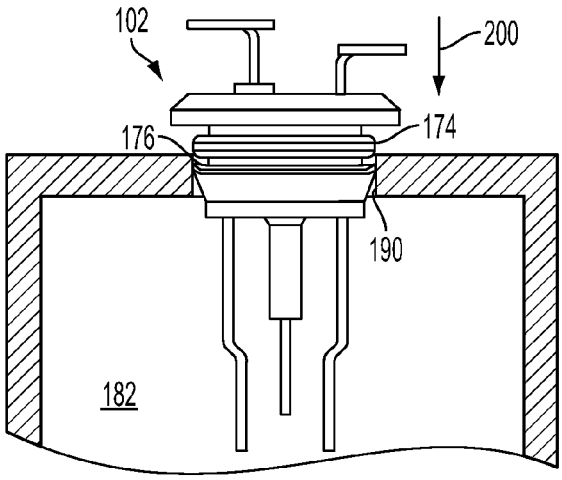
FIG. 9 depicts a partial cross-sectional view of the tank of FIG. 6 with the barbed portion of the probe assembly of FIG. 2 deformed so as to fit within the port.

Insertion of the probe assembly 102 in the direction of the arrow 200 continues until the barb portion 176 is adjacent the port 190. As shown in FIG. 8, the barb portion 176 has a diameter that is larger than the diameter of the port 190. In one embodiment the port 190 has a diameter of 10 millimeters and the barb portion 176 has a diameter that is greater than 10 millimeters. Continued pressure on the probe assembly 102 in the direction of the arrow 200 while in the configuration of FIG. 8 thus causes the barb portion 176 to deform as shown in FIG. 9, allowing the probe assembly 102 to be further inserted into the reservoir 182.

The seal portion 174 also has a diameter larger than the diameter of the port 190, although smaller than the diameter of the barb portion 176. Accordingly, continued pressure in the direction of the arrow 200 causes the seal portion 174 to deform and enter into the port 190. The distance between the top of the barb portion 176 and the bottom of the platform 172 is selected to be just slightly less than the wall thickness of the tank 180 about the port 190. Accordingly, as the platform 172 contacts the tank 180, continued pressure in the direction of the arrow 200 causes deformation of the platform 172 sufficient to force the barb portion 176 through the port 190 and into the reservoir 182 and the barb portion 176 flexes back to its un-deformed shape. The diameter of the platform 172 is larger than the diameter of the port 190, however, and the shape of the platform 172 is selected to inhibit movement of the platform 172 fully into the port 190. Accordingly, the platform 172 does not deform to the extent necessary to fit within the port 190.

Figure 10:
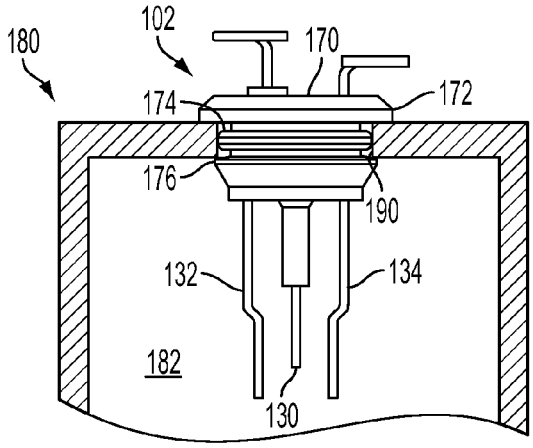
FIG. 10 depicts a partial cross-sectional view of the tank of FIG. 6 with the barbed portion of the probe assembly of FIG. 2 within the tank whereby the probe assembly is firmly held within the port and the seal portion of the boot seals the port.

At this point, the probe assembly 102 is in the condition shown in FIG. 10. Specifically, the platform 172 and the barb portion 176 are located on the outer surface and inner surface of the tank 180, respectively, and resiliently pressing on the opposite sides of the tank. Additionally, the seal portion 174 is positioned within the port 190 and resiliently pressing against the wall of the port 190. Thus, the port 190 is tightly sealed by the boot 170 and the probe assembly 102 is firmly positioned on the tank 180 with the sense probe 130 and the driver probes 132 and 134 within the reservoir 182.

Figure 11:
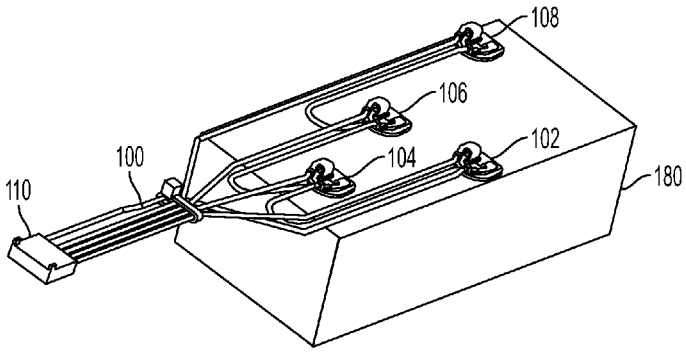
FIG. 11 depicts a top perspective view of the sensor assembly of FIG. 1 with the probe assemblies inserted within the sensor ports of the tank of FIG. 6.

Similarly, the probe assemblies 104, 106 and 108 may be inserted into the ports 192, 194, and 196 and electrically connected to form the sensor assembly 100 as depicted in FIG. 11. The sensor assembly 100 may then be coupled to a device control circuit 210 shown in FIG. 12. The control circuit 210 includes a processor 212, and a memory 214. A power source 218 provides power to the components of the control circuit 210. The power source 218 may be an alternating current or direct current power source or a combination power source for providing different types of power to different components.

Figure 12:
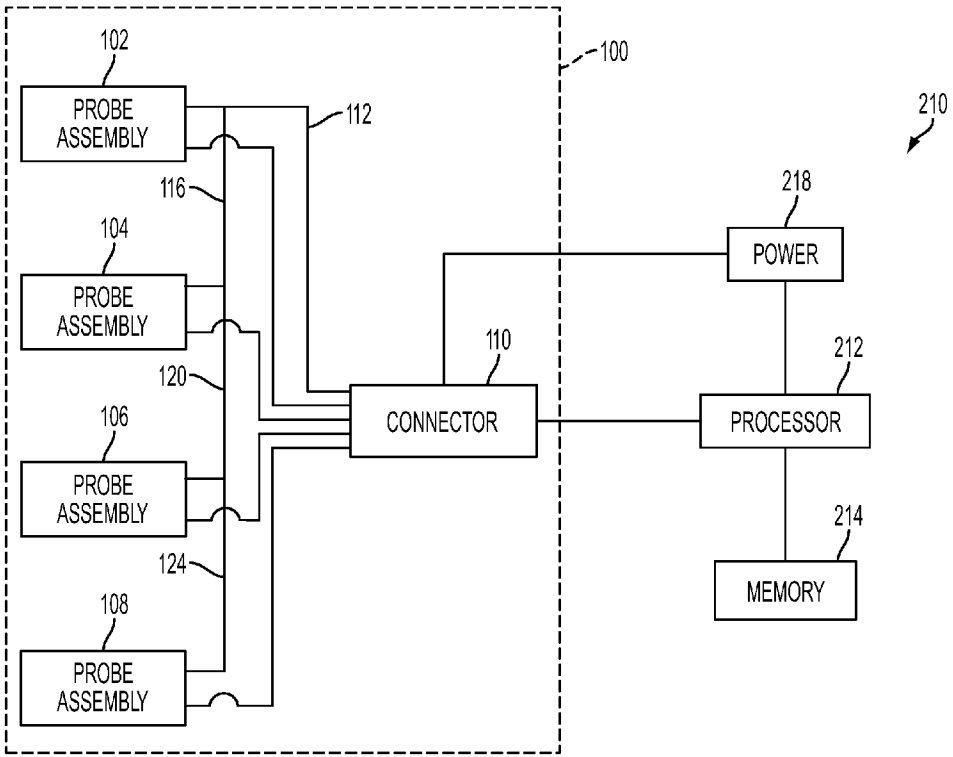
FIG. 12 depicts a schematic of a control circuit used to associate a signal received from the sensor assembly of FIG. 1 with a fluid level.
Figure 13:
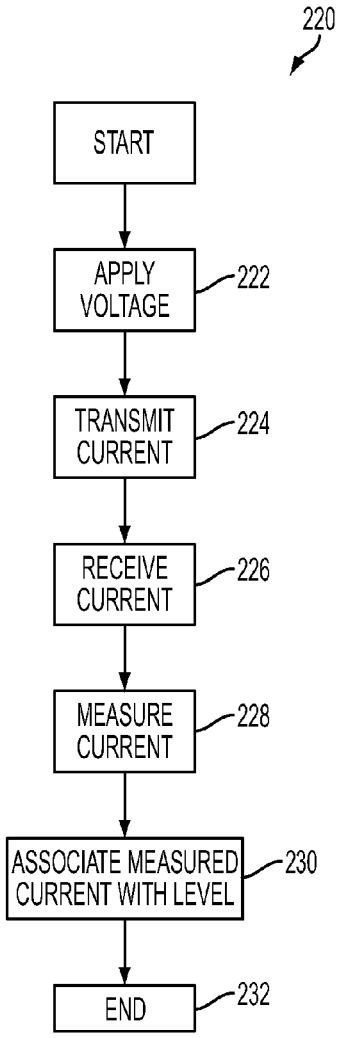
FIG. 13 depicts a method of associating a signal received from the sensor assembly of FIG. 1 with a fluid level that may be executed by the control circuit of FIG. 12.

The memory 214 is programmed with command instructions which, when executed by the processor 212, provide performance of various control functions. In one embodiment, the processor 212 executes command instructions which associate a signal received from the sensor assembly 100 with a fluid level within the tank 180 in accordance with the procedure 220 of FIG. 13. In accordance with the procedure 220, voltage is applied to the sensor assembly 100 (block 222). As shown in FIG. 12, voltage applied to the sensor assembly 100 is passed through the supply lead 112 to the probe assembly 102. Additionally, the voltage is applied to the probe assemblies 104, 106 and 108 through the branch supply leads 116, 120 and 124, respectively.

The description of process 220 continues herein with reference to the probe assembly 102, but the process applies as well to the operation of the probe assemblies 104, 106, and 108. The applied voltage is connected through supply lead 112 to the prong 138 of the probe assembly 102 (see FIG. 4) to the driver probe 134 and via the crossbar 152 to the driver probe 132. The voltage applied to the driver probes 132 and 134 causes current flow through the ink from driver probes 132 and 134 to sense probe 130 (block 224). The respective side of the plate portion 142 and the respective side of shank portion 140 extending out of the sleeve 178 facing the respective driver probe 132 or 134 receives the transmitted current from the respective driver probe 132 or 134 (block 226).

The received current is measured (block 228). The processor 212 then associates the measured current with a fluid level for the reservoir 182 (block 230) and the process 220 ends (block 232). Data obtained or derived during execution of the process 220 may be stored for use by other processes.

Association of the received signal with a fluid level is possible by insertion of the sensor assembly 100 into a tank wherein the fluid being measured has a conductivity that is significantly different from the fluid, such as air, which replaces the measured fluid. In such a system, the resistance experienced by current passing between the probe surfaces can be shown as:

$$R = \frac{k}{K}$$

wherein:

"R" is the resistance to passing the current,

"k" is a transmissivity factor, and

"K" is the conductivity of the fluid located between the probes.

The resistance to passing a current is thus a function of the fluid located between the probes. When the sensor assembly 100 is used in an ink printing device, the fluid between the probes is ink, air, or a combination of ink and air. The liquid ink has a significantly higher conductivity than the air. Accordingly, as the ink forms a current path between the driver probes 132 and 134 and the sense probe 130, the total resistance to passing the signal decreases. Thus, the magnitude of the transmitted current received by the sense probe 130 increases.

The transmissivity factor is a function of other variables which affect the magnitude of the transmitted current received by the sense probe 130 such as the distance between the probes and the surface area of the probes through which current flows from the driver probes 132 and 134 to the sense probe 130. This relationship can be shown as:

$$k = \frac{d}{a}$$

wherein:

"k" is a transmissivity constant,

"d" is the distance between the probe surfaces and

"a" is the combined surface transmission/reception area of the probes through which current passes.

Thus, for a given applied current with a constant distance between probes, an increase in the surface transmission/reception area results in a smaller transmissivity constant. Accordingly, the resistance to passage of a current between the probes decreases. As the resistance to passage of a current decreases, the received current increases. Additionally, as the distance between the probes decreases, the transmissivity constant decreases and the resistance to passage of a current between the probes decreases.

In general, as the magnitude of the received current increases, the sensitivity of the system to changes in resistance to the passing of current increases. Thus, optimal sensitivity is achieved by minimizing the distance between probes and maximizing the surface area of the probes. The minimization of distance between probes and the surface area of the probes, however, are constrained by the particular application.

With reference to the distance between the probes, a fluid begins to "wick" or draw up between the probes as the distance between the probes is reduced. The sensed level of fluid in a system wherein wicking is occurring in the sensor is higher than the actual level in the system. The error is exacerbated as the fluid level decreases because the surface tension of the fluid acts to keep the fluid in contact with areas of the probe that have previously been wetted, even if the actual fluid level has been lowered. In extreme cases, wicking can result in "bridging" between probes, wherein the surface tension of the fluid maintains the wicked fluid between the probes even when the fluid in the remainder of the system is no longer in contact with the probes. For particular ink systems, maintaining a minimum of about 2 millimeters distance between adjacent surfaces reduces the effects of wicking to an acceptable level.

Figure 14:
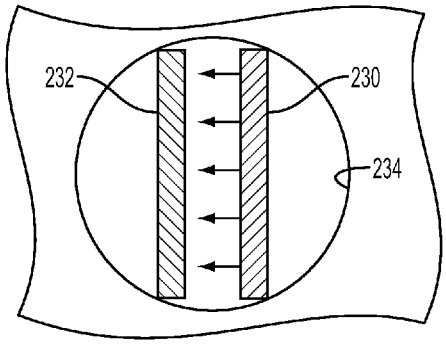
FIG. 14 depicts a cross-sectional view of a driver probe and a sense probe that have been inserted into a tank viewed through a probe assembly port.

The area of the probes that can be used in a particular system is also constrained. In the tank 180 of FIG. 6, the sense probe 130 and the driver probes 132 and 134 must be sized to fit within the port 190. With reference to FIG. 14, the width of the driver probe 230 and the sense probe 232 must be less than the diameter of the port 234. The port 234 has a diameter of 10 millimeters. Accordingly, when maintaining a separation between the drive probe 230 and the sense probe 232 of about 2 millimeters, the maximum width of the drive probe 230 and the sense probe 232 is slightly more than 9 millimeters. Thus, each incremental change in liquid level along the height of the drive probe 230 and the sense probe 232 results in a change of about of 18 millimeters multiplied by the increment in the surface area through which current is passed by the drive probe 230 and the sense probe 232.

Figure 15:
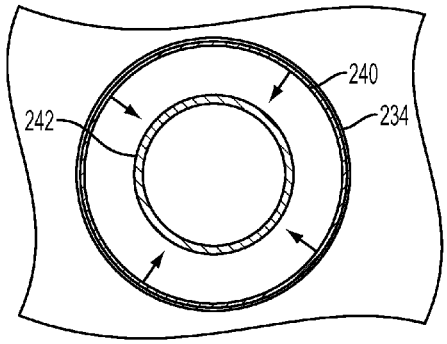
FIG. 15 depicts a cross-sectional view of a driver probe and a sense probe that have been inserted into a tank viewed through the probe assembly port of FIG. 14 which provide increased sensitivity compared to the driver probe and a sense probe of FIG. 14.

The surface area through which current is passed for a driver probe/sense probe combination can be increased by shaping the probes differently. By way of example, a driver probe 240 and a sense probe 242 are shown in FIG. 15 within the port 234. The driver probe 240 and the sense probe 242 each have a surface facing the opposite probe that extends in excess of 18 millimeters. Thus, each incremental change in liquid level along the height of the driver probe 240 and the sense probe 242 results in a change which is greater than 36 millimeters multiplied by the increment in the surface area through which current is passed by the driver probe 240 and the sense probe 242.

Thus, the driver probe 240 and the sense probe 242 are much more sensitive than the driver probe 230 and the sense probe 232. The manufacturing costs, however, of the driver probe 240 and the sense probe 242 are greater than the manufacturing costs for the driver probe 230 and the sense probe 232 because of the more complicated shape.

An alternative approach to increasing sensitivity without the same increase in manufacturing costs incurred with the driver probe 240 and the sense probe 242 is to utilize two surfaces of a sense probe to pass current. For example, the system 250 shown in FIG. 16 includes two driver probes 252 and 254. A third probe, sense probe 256, is positioned between the driver probes 252 and 254. The driver probes 252 and 254 each have a single active surface 258 and 260, respectively. The sense probe 256 has two active surfaces 262 and 264.

In order to maintain a spacing of 2 millimeters between each of the probes, the cross-sectional length of the probes in the system 250 must be reduced as compared to the cross-sectional length of the driver probe 230 and the sense probe 232. In this embodiment, the driver probes 252 and 254 and the sense probe 256 have a length of just over 7 millimeters. Both active surfaces 262 and 264 of the sense probe 256, however, receive current from a driver probe 252 and 254, respectively as indicated by the arrows 266. Accordingly, each millimeter change in liquid level along the height of the system 250 results in an area change which is greater than 14 square millimeters. Accordingly the sensitivity of the system 250 is greatly increased as compared to the driver probe 230 and the sense probe 232 without making the manufacture of the system substantially more complicated.

Figure 2:
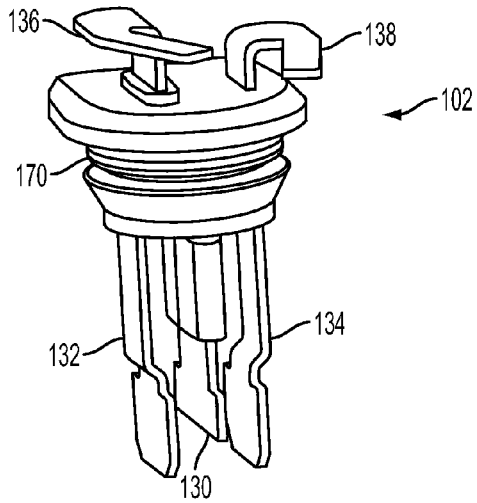
FIG. 2 depicts a side perspective view of a probe assembly of FIG. 1.
Figure 16:
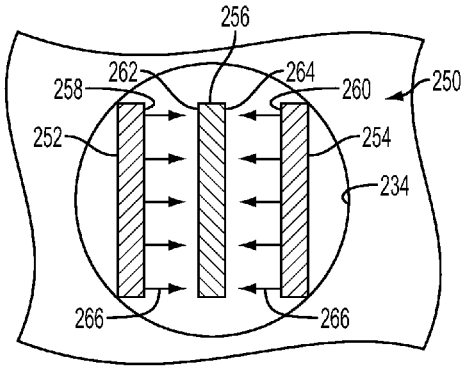
FIG. 16 depicts a cross-sectional view of a driver probe and a sense probe that have been inserted into a tank viewed through the probe assembly port of FIG. 14 which provide increased sensitivity compared to the driver probe and a sense probe of FIG. 14.
Figure 17:
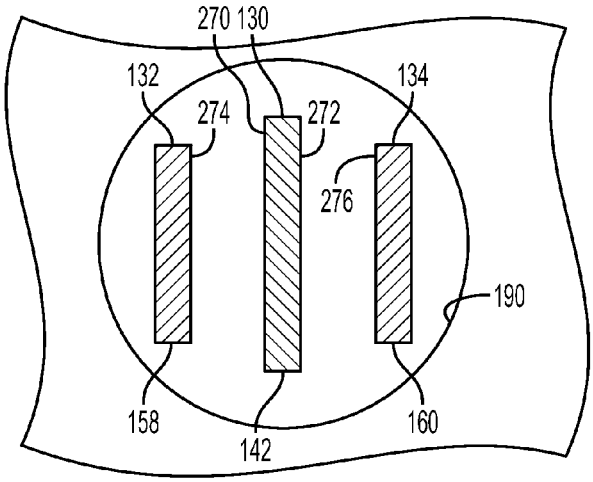
FIG. 17 depicts a cross-sectional view of the plate portions of the driver probes and sense probe of the probe assembly of FIG. 2 inserted within the tank of FIG. 6 as viewed through the probe assembly port of FIG. 6.

The probe assembly 102 of FIG. 2 is similar to the system 250 of FIG. 16. By way of example, FIG. 17 depicts a cross sectional view of the driver probes 132 and 134 and the sense probe 130 taken across the plate portions 142, 158 and 160, respectively, as viewed through the port 190. The plate portion 142 has two active surfaces 270 and 272 while the plate portions 158 and 160 each have a single active surface 274 and 276, respectively. In this embodiment, the only difference between the active surfaces 274 and 276 and the opposite surfaces of the plate portions 158 and 160 is that the opposite surfaces do not face toward the sense probe 130.

Figure 3:
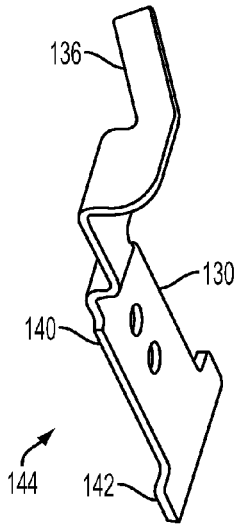
FIG. 3 depicts a top perspective view of the sense probe of the probe assembly of FIG. 2 that can be formed from a flat sheet of material.
Figure 4:
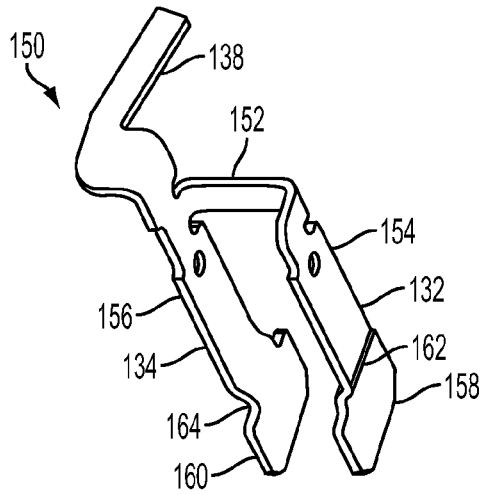
FIG. 4 depicts a top perspective view of the driver probes of the probe assembly of FIG. 2 that can be formed from a flat sheet of material.
Figure 5:
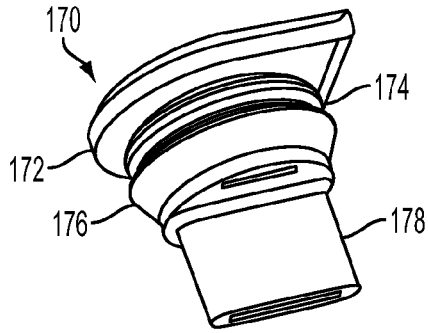
FIG. 5 depicts a side perspective view of the boot of the probe assembly of FIG. 2 that can be used to electrically isolate the probes from a tank as well as support and electrically isolate the sense probe and the driver probes.
Figure 18:
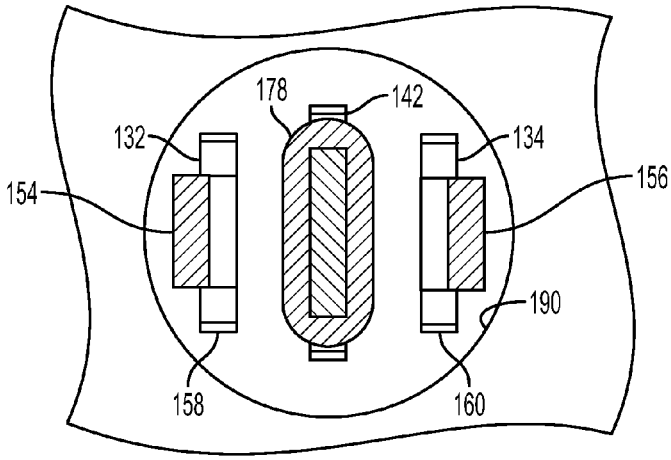
FIG. 18 depicts a cross-sectional view through the shank portions of the driver probes and sense probe of the probe assembly of FIG. 2 inserted within the tank of FIG. 6 as viewed through the probe assembly port of FIG. 6.

The plate portions 142, 158 and 160 in this embodiment are spaced 2 millimeters apart to reduce the potential for wicking while maintaining good sensitivity. As shown in FIGS. 2-4, the driver probes 132 and 134 include curved sections 162 and 164 which position the driver probes 132 and 134 at about 2 millimeters away from the sense probe 130. The divergence is provided to maintain 2 millimeters between the shank portions 154 and 156 and the sleeve 178 as shown in FIG. 18. The sleeve 178 reduces the sensitivity of the probe assembly 102 but provides for increased reliability.

Specifically, when ink reaches the bottom of the barb portion 176 of the probe assembly 102, the boot 170 provides an additional surface to which the ink or other fluid can adhere. Accordingly, a permanent surface tension bridge can be created which spans a distance larger than the distance at which wicking for the particular fluid occurs. A permanent fluid bridge between two active surfaces would produce a constant current path, resulting in an artificially high received current. Providing the non-conductive sleeve 178 about the shank portion 140 of the sense probe 130 prevents any fluid bridging on the bottom of the barb portion 176 from joining two active surfaces.

Comparing the cross-sections of the shank portions 154 and 156 of FIG. 18 with the cross-sections of the plate portions 158 and 160 shown in FIG. 17 reveals that the cross sectional lengths of the surfaces of the shank portions 154 and 156 facing the sense probe 130 are much less than the cross sectional lengths of the surfaces of the plate portions 158 and 160. The increased dimension of the plate portions 158 and 160, which is enabled by offsetting of the plate portions 158 and 160 from the shank portions 154 and 156, results in increased sensitivity for fluid levels at the lower portion of the sense probe 130 and driver probes 132 and 134.

Figure 19:
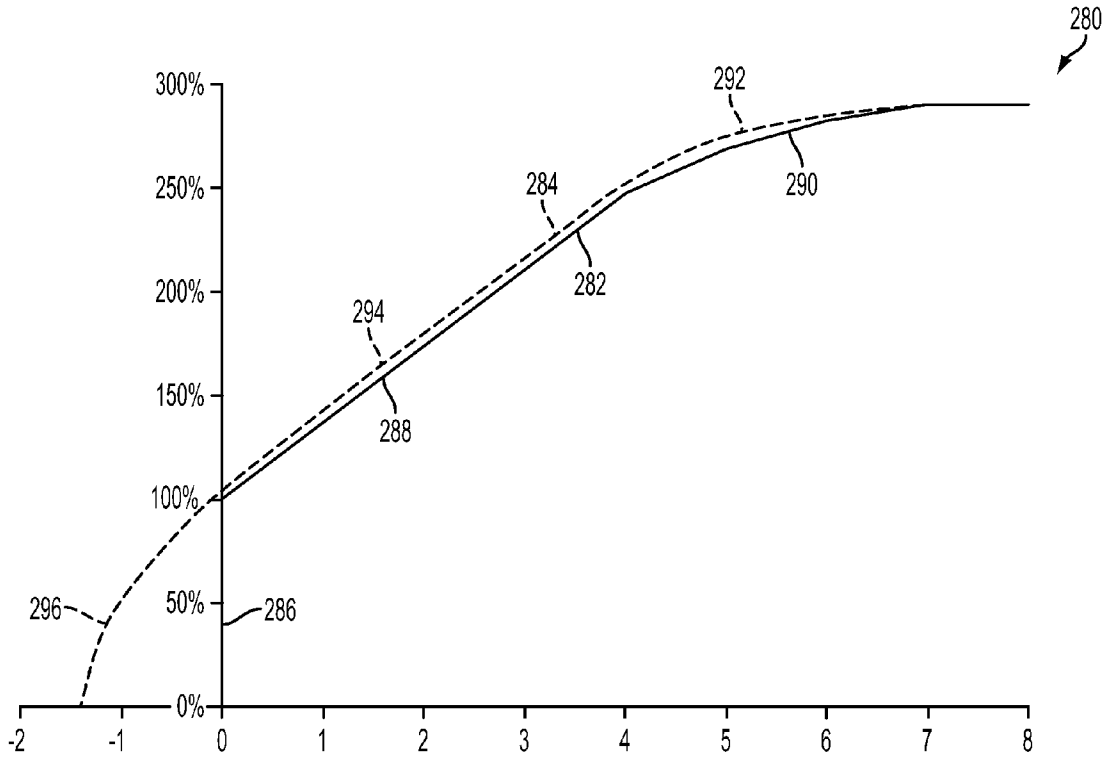
FIG. 19 depicts a conductivity curve obtained for a probe assembly positioned within a tank as the tank is filled with fluid and then as the fluid is removed from the tank.

The conductivity curve 280 shown in FIG. 19 evidences the increased sensitivity for fluid levels at the lower portion of the sense probe 130 and driver probes 132 and 134. The conductivity curve 280 is generated using a procedure similar to the procedure 220 of FIG. 13. The main difference is that in addition to measuring a current received by the sense probe 130 as the fluid level (ink) in a tank is raised and then lowered, the level of the tank is measured and associated with a received calibration current to provide the conductivity curve portion 282 and the conductivity curve portion 284. The horizontal axis for the conductivity curve 280 identifies the level of the ink in millimeters above the bottom of the plate portion 142. The vertical axis identifies the magnitude of the current received by the sense probe 130 normalized to the value of the received current when the ink first contacts the plate portion 142.

The conductivity curve portion 282 exhibits three distinct characteristics. As the ink level in the tank first reaches the bottom of the sense probe 130, the received current suddenly increases at segment 286 because the conductivity of the ink is greater than the conductivity of air. The value to which the received current rises is normalized to 100% in the FIG. 19.

If desired, the sudden increase characteristic may be used as a level indicator to indicate whether or not the measured fluid is at a particular level in the tank. In such embodiments, a processor may be controlled to detect the sudden increase using data from a probe assembly, such as one or more of the probe assemblies 102, 104, 106, and 108, compared to single threshold value. The threshold value may be established at a value less than the value to which the received current is expected to rise to provide a robust system. Such values may be between about 25% and 50% of the value to which the received current is expected to rise. According to this embodiment, the entire conductivity curve 280 need not be stored for use by the processor.

Continuing with the conductivity curve 280, a substantially linear segment 288 extends from 0 to about 4 millimeters, corresponding to increased current received by the probe 130 as the level of fluid increases from the bottom of the plate portion 142 to the bottom of the non-conductive sleeve 178. The conductivity curve portion 282 then exhibits a curved segment 290 indicating decreased sensitivity to change in fluid level as the level of fluid continues to increase along the active shank portions 154 and 156 of the driver probes 132 and 134, respectively, to the bottom of the boot 170 at 8 millimeters. If desired, the driver probes 132 and 134 and/or the sense probe 130 could be of a non uniform shape in one or more axes to compensate for the non-linearity or to alter the conduction slope relative to volume.

As the ink level is lowered, the value of the received calibration current (conductivity curve portion 284) is consistently greater than the value of the calibration current received as the ink level was raised (conductivity curve portion 282) for a given level below about 7 millimeters. This difference is the result of the resistance to movement of fluid between the sense probe 130 and the driver probes 132 and 134 produced by surface tension of the ink. Thus, a portion of the probes located above the nominal level of the fluid remains in contact with the fluid as the fluid level is lowered.

The shape of the conductivity curve portion 284 above the 0 millimeter mark is similar to the conductivity curve portion 282 with a curved segment 292 extending from about 7 millimeters to about 4 millimeters followed by a substantially linear segment 294 down to 0 millimeters. Below 0 millimeters, the conductivity curve portion 284 exhibits a second curved segment 296 which is explained with reference to FIG. 20.

Figure 20:
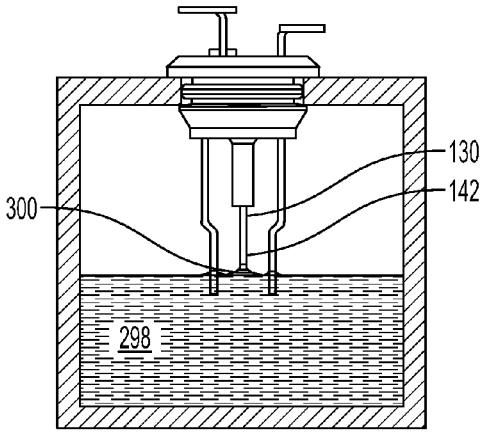
FIG. 20 depicts a cross-sectional view of the tank of FIG. 6 partially filled with fluid with the probe assembly of FIG. 2 inserted within the tank wherein the fluid level is below the level of the sense probe but a fluid bridge is formed between the sense probe and the driver probes.

As shown in FIG. 20, even when the level of the ink 298 drops below the level of the sense probe 130, the surface tension of the ink 298 maintains a bridge 300 with the sense probe 130 through which current may be received. The segment 296 of FIG. 19 reflects the bridging between the ink 298 and the plate portion 142 which is present until the bridge is broken when the ink level in the tank drops to about −1.4 millimeters below the bottom of the plate portion 142.

Accordingly, the conductivity curves 282 and 284 may be obtained for a particular fluid exhibiting a particular conductivity through a calibration procedure and thereafter used to associate the received current with the level of fluids in the tank 180 during operation of the device using the fluid. In the event the fluids in the reservoirs 182, 184, 186, and 188 vary from each other, different conductivity curves may be generated for each fluid. Data reflective of the conductivity curve or curves may then be stored within the memory 214 (FIG. 12) for use in associating the signal indicative of the received current during operations with a level of fluid within the particular reservoir 182, 184, 186, or 188.

Depending upon the accuracy desired, data indicative of both conductivity curve portion 282 and conductivity curve portion 284 may be stored in the memory 214. The storage of this data allows the data indicative of conductivity curve portion 282 to be used for recalibration of the curve 280, as discussed below, and level determination as the reservoir 182 is filled while the data indicative of conductivity curve portion 284 is used for associating received operational signals with a fluid level as the fluid level decreases.

In addition to being used to identify the absence or presence of a fluid, the sudden rise characteristic of the conductivity curve 282 at the segment 286 of FIG. 19 may be used to recalibrate the probe assembly 102. By way of example, when the fluid within the reservoir 182 is depleted, the fluid is replaced. If the conductivity of the new fluid is different from the conductivity of the depleted fluid, the initial value of current that is received with the sudden increase of the new fluid will vary from the initial value achieved with the depleted fluid. The difference in the value achieved may be considered to result from the difference in conductivity between the two fluids. Since nothing in the system other than the conductivity of the fluid has changed, the conductivity curve 280 may be normalized using the initial value achieved by the new fluid, thereby recalibrating the system to reflect the conductivity of the new fluid.

For embodiments wherein the initial increase in conductivity is used to calibrate the system, the sense probe may be shortened to reduce the introduction of errors in the event the tank is not level or in the event the surface of the fluid is not level, such as when ripples on the surface of the fluid are generated during fill operations.

Figure 21:
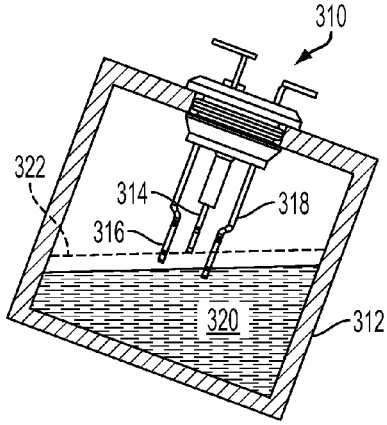
FIG. 21 depicts a cross-sectional view of a tilted tank partially filled with fluid with a probe assembly inserted within the tank wherein the sense probe has a length shorter than the length of the driver probes such that both driver probes are contacted by the fluid prior to the fluid contacting the sense probe as the tank is filled.

By way of example, FIG. 21 depicts a probe assembly 310 positioned within a tank 312. The probe assembly 310 is identical to the probe assembly 102, including a sense probe 314 and two driver probes 316 and 318. The tank 312 is partially filled with a fluid 320 which is below the sense probe 314. Accordingly, even though the probe 318 is in contact with the fluid 320, no current is received.

As the level of the fluid 320 increases to the level 322, the fluid 320 first contacts the driver probe 316 and then the sense probe 314. Thus, when the fluid 320 rises to the level 322, a current path exists between both the driver probe 316 and the sense probe 314 and the driver probe 318 and the sense probe 314.

Figure 22:
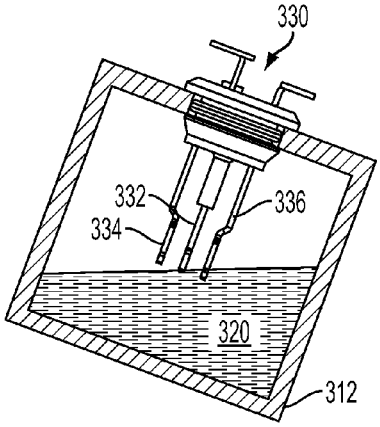
FIG. 22 depicts a cross-sectional view of the tilted tank of FIG. 21 with a probe assembly inserted within the tank wherein the sense probe has the same length as the driver probes such that the sense probe may be contacted by fluid prior to the fluid contacting one of the driver probes as the tank is filled.

In contrast, FIG. 22 shows the tank 312 and fluid 320 with a probe assembly 330 in place of the probe assembly 310. The probe assembly 330 includes a sense probe 332 that is the same length as the driver probes 334 and 336. Accordingly, when the tank 312 is tilted at the same angle and has the same amount of fluid 320 as in FIG. 21, the fluid 320 creates a current path between the driver probe 336 and the sense probe 332. The driver probe 334, however, is not in contact with the fluid 320. Accordingly, there is no significant flow of current from the driver probe 334 to the sense probe 332. Thus, the initial value to which the received current rises is lower than the initial value to which the received current rises in the case of the probe 310, introducing an error into the scaling performed by the associated processor.

Figure 23:
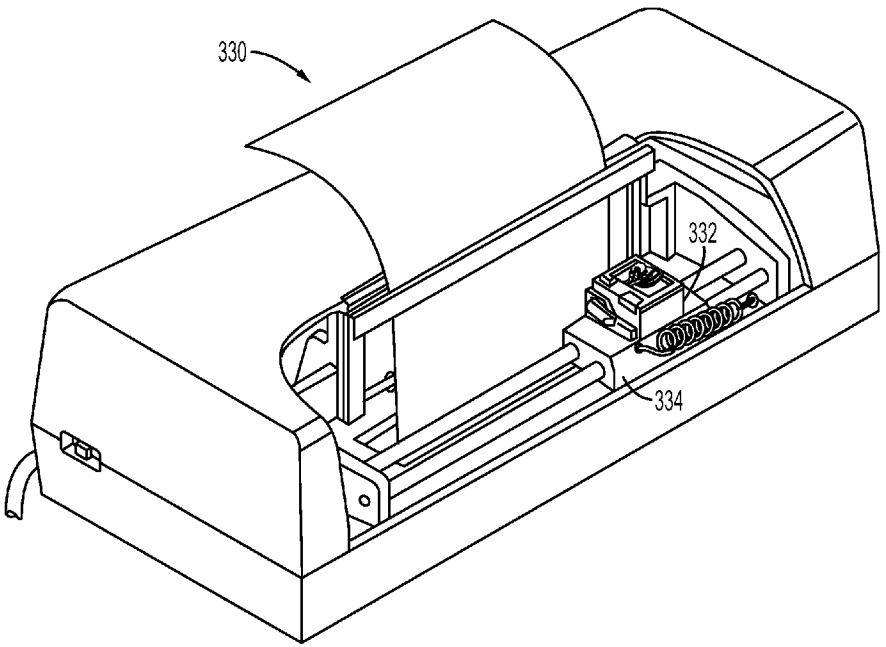
FIG. 23 depicts a perspective view of a printer with a removable cartridge including a probe assembly incorporating principles of the invention.
Figure 24:
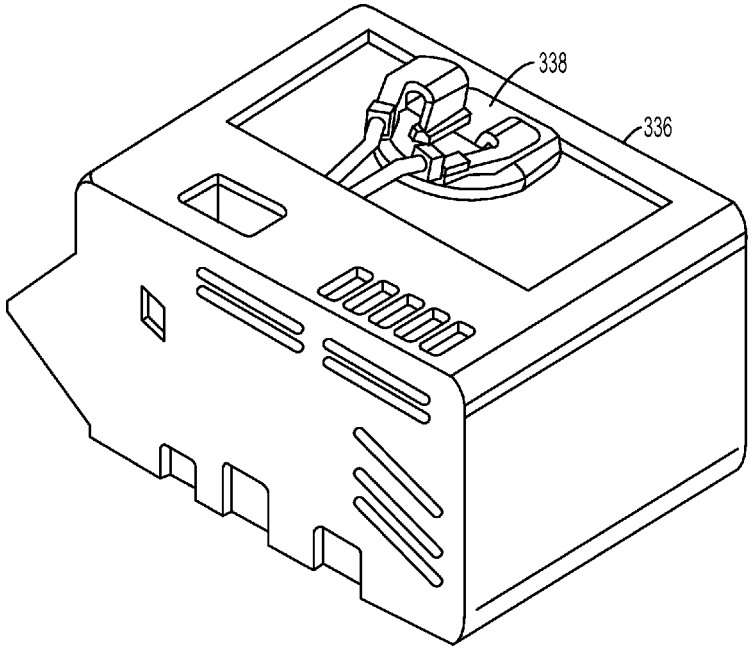
FIG. 24 depicts a perspective view of the removable cartridge of the printer of FIG. 23.

In a further embodiment, a probe assembly is provided with a removable tank. Referring to FIG. 23, a printer 330 includes a printhead assembly 332 positioned on a carriage 334. The printhead assembly 332 includes a cartridge 336, shown in FIG. 24, which is removable from the carriage 334. Alternatively, the entire printhead assembly 332 may be removable. The cartridge 336 may include nozzles (not shown) or the nozzles may be located elsewhere on the printhead assembly.

A probe assembly 338 is mounted on the cartridge 336. The probe assembly 338 is substantially the same as the probe assemblies 102, 104, 106, and 108. Rather than a connector such as the connector 110, however, the probe assembly 338 is controlled through a printed circuit board. Thus, supply lead 340 and a return lead 342 extend between the probe assembly 338 and a printed circuit board (not shown) within the housing of the cartridge 336. Although the printer 330 includes a single removable cartridge, in other embodiments multiple removable cartridges are provided in a printer, each of the cartridges including a probe assembly.

Although the present invention has been described with respect to certain preferred embodiments, it will be appreciated by those of skill in the art that other implementations and adaptations are possible. Moreover, there are advantages to individual advancements described herein that may be obtained without incorporating other aspects described above. Therefore, the spirit and scope of the appended claims should not be limited to the description of the preferred embodiments contained herein.

What is claimed is:

1. A method of sensing the level of at least one fluid in a device comprising:

applying a voltage to a first probe in a first reservoir to generate a first calibration current;

receiving the first calibration current with a first surface of a second probe in the first reservoir;

applying the voltage to a third probe in the first reservoir to generate a second calibration current;

receiving the second calibration current with a second surface of the second probe in the first reservoir;

obtaining a first plurality of data indicative of the first calibration current received at the first surface of the second probe;

associating each datum in the first plurality of data with a different portion of a surface area of the first surface of the second probe that contacts a first fluid in the first reservoir, each different portion of the surface area corresponding to a fluid level in the first reservoir;

storing the first plurality of data and the associated portions of the surface area of the first surface of the second probe in a memory;

obtaining a plurality of data indicative of the second calibration current received at the second surface of the second probe in the first reservoir;

associating each datum of the plurality of data indicative of the second calibration current with a different portion of a surface area of the second surface of the second probe that contacts the first fluid in the first reservoir;

storing the plurality of data indicative of the second calibration current with the associated portions of the surface area of the second surface of the second probe in the memory with the first plurality of data;

applying the voltage to the first probe in the first reservoir to generate a first operational current;

receiving the first operational current with the first surface of the second probe in the first reservoir;

obtaining a first signal indicative of the first operational current received at the first surface of the second probe in the first reservoir;

associating the first signal with a fluid level associated with a corresponding datum in the first plurality of data stored in the memory;

applying the voltage to the third probe to generate a second operational current;

receiving the second operational current with the second surface of the second probe;

obtaining a signal indicative of the second operational current received at the second surface of the second probe in the first reservoir; and associating the signal indicative of the second operational current with a fluid level associated with a corresponding datum in the plurality of data indicative of the second calibration current stored in the memory.

2. The method of claim 1 wherein associating each datum in the first plurality of data comprises:

determining a value to which the first calibration current rises following a sudden increase in the first calibration current received at the first surface of the second probe; and normalizing each datum in the first plurality of data with reference to the determined value.

3. The method of claim 1 further comprising:

determining a value to which the first operational current rises following a sudden increase in the first operational current received at the first surface of the second probe; and calibrating each datum in the first plurality of data with reference to the determined value.

4. A method of sensing a level of at least one fluid in a device comprising:

applying a voltage to a first probe in a first reservoir to generate a first calibration current;

receiving the first calibration current with a first surface of a second probe in the first reservoir;

obtaining a first plurality of data indicative of the first calibration current received at the first surface of the second probe;

associating each datum in the first plurality of data with a different portion of a surface area of the first surface of the second probe that contacts a first fluid in the first reservoir, each different portion of the surface area corresponding to a fluid level in the first reservoir;

storing the first plurality of data and the associated portions of the surface area of the first surface of the second probe in a memory;

applying the voltage to the first probe in the first reservoir to generate a first operational current;

receiving the first operational current with the first surface of the second probe in the first reservoir;

obtaining a first signal indicative of the first operational current received at the first surface of the second probe in the first reservoir;

associating the first signal with a fluid level associated with a corresponding datum in the first plurality of data stored in the memory;

applying the voltage to a third probe in a second reservoir to generate a second calibration current;

receiving the second calibration current with a surface of a fourth probe in the second reservoir;

obtaining a plurality of data indicative of the second calibration current received at the surface of the fourth probe in the second reservoir;

associating each datum of the plurality of data indicative of the second calibration current with a different portion of a surface area of the fourth probe that contacts a second fluid in the second reservoir;

storing the plurality of data indicative of the second calibration current with the associated portions of the surface area of the fourth probe in the memory;

applying the voltage to the third probe to generate a second operational current;

receiving the second operational current with the surface of the fourth probe;

obtaining a signal indicative of the second operational current received at the surface of the fourth probe in the second reservoir; and associating the signal indicative of the second operational current with a fluid level associated with a corresponding datum in the plurality of data indicative of the second calibration current stored in the memory.

* * * * *